US009515411B2

(12) United States Patent
Matsuura

(10) Patent No.: US 9,515,411 B2
(45) Date of Patent: Dec. 6, 2016

(54) CONNECTOR WITH LEVER

(71) Applicant: Sumitomo Wiring Systems, Ltd., Yokkaichi, Mie (JP)

(72) Inventor: Masahito Matsuura, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/978,028

(22) Filed: Dec. 22, 2015

(65) Prior Publication Data

US 2016/0204538 A1 Jul. 14, 2016

(30) Foreign Application Priority Data

Jan. 14, 2015 (JP) ..... 2015-004819

(51) Int. Cl.
*H01R 13/62* (2006.01)
*H01R 13/502* (2006.01)
*H01R 13/629* (2006.01)

(52) U.S. Cl.
CPC ..... *H01R 13/502* (2013.01); *H01R 13/62938* (2013.01)

(58) Field of Classification Search
CPC ..... H01R 13/502; H01R 13/62933; H01R 13/62938; H01R 13/62955
USPC ..... 439/157, 358, 372
See application file for complete search history.

(56) References Cited

U.S. PATENT DOCUMENTS 8,979,567 B2 * 3/2015 Kamiya ..... H01R 13/62977 439/157
8,998,626 B2 * 4/2015 Kitajima ..... H01R 12/716 439/147
9,022,793 B2 * 5/2015 Kobayashi ..... H01R 13/5213 439/157
9,028,265 B2 * 5/2015 Aoki ..... H01R 13/62933 439/157
2001/0021599 A1 * 9/2001 Kurimoto ..... H01R 13/62938 439/157

FOREIGN PATENT DOCUMENTS

JP 2012-146445 8/2012

* cited by examiner

*Primary Examiner* — Khiem Nguyen
(74) *Attorney, Agent, or Firm* — Gerald E. Hespos; Michael J. Porco; Matthew T. Hespos

(57) ABSTRACT

A connector assembly has first and second connectors (10, 40). The first connector (10) has a housing (11) with a terminal accommodating portion (13) for accommodating terminal fittings (12) and a lever accommodating portion (14). The second connector (40) has a receptacle (44) for receiving the first connector (10). A lever (30) is provided in the lever accommodating portion (14) and can be operated to connect or separate the connectors (10, 40). Guide grooves (15) are provided between the terminal accommodating portion (13) and the lever accommodating portion (14) and guide ribs (48) project on an inner peripheral surface of the receptacle (44). The guide ribs (48) engage in the guide grooves (15) to prevent the connectors (10, 40) from inclining during a connecting operation.

5 Claims, 10 Drawing Sheets

CONNECTOR WITH LEVER

BACKGROUND

1. Field of the Invention

The invention relates to a connector with lever.

2. Description of the Related Art

Japanese Unexamined Patent Publication No. 2012-146445 discloses a known connector that has a housing with a terminal accommodating portion and a lever accommodating portion on one side of the terminal accommodating portion. The terminal accommodating portion accommodates terminal fittings and can be fit into a receptacle of a mating connector. A plate-shaped lever is mounted movably in the lever accommodating portion of the housing and has a cam groove. The lever can be operated while engaging the cam groove of the lever with a cam pin of the mating connector to generate a cam action that causes the connector and the mating connector to be connected or separated. However the side of the connector that has the lever tends to move earlier than the side of the connector opposite the lever. Thus, the connector tends to incline in the receptacle of the mating connector, and an improvement has been desired.

The invention was completed based on the above situation and aims to provide a connector with lever that can prevent the connector from being inclined when the connector is connected

SUMMARY

The invention is directed to a connector assembly with first and second connectors. The first connector has a housing with a terminal accommodating portion for accommodating terminal fittings and a lever accommodating portion for accommodating a lever. The second connector has a receptacle that can receive the terminal accommodating portion of the first connector. The lever can be operated to cause the terminal accommodating portion of the first connector to move into the receptacle of the second connector or to separate from the receptacle of the second connector. A guide rib projects on an inner peripheral surface of the receptacle and a guide groove is provided between the terminal accommodating portion and the lever accommodating portion. The guide rib can be fit into the guide groove without clearance in an arrangement direction of the terminal accommodating portion and the lever accommodating portion.

The guide rib contacts the guide groove in the arrangement direction of the terminal accommodating portion and the lever accommodating portion at a position near the lever, and hence at a position where the connector tends to incline forward by the operation of the lever. Therefore, inclination of the connector during the connection can be prevented.

The terminal fittings are connected to end parts of wires that are pulled out from a rear surface of the housing. A wire cover for covering pulled-out parts of the wires may be slid onto the rear surface of the housing in an intersecting direction that intersects the arrangement direction. A guiding rib for guiding a sliding movement of the wire cover is provided within a formation range of the guide groove in the arrangement direction of the housing. According to this configuration, a dimension of the connector in the arrangement direction of the terminal accommodating portion and the lever accommodating portion can be made compact as compared to the case where the guide groove and the guiding rib are provided at positions displaced in the arrangement direction of the terminal accommodating portion and the lever accommodating portion.

A lightening portion may be provided in a part of the housing located inward of the guide groove. According to this configuration, the part of the housing located inward of the guide groove is thin and sinks are not formed.

The lightening portion may have a reinforcing wall to enhance the strength of the housing while preventing the formation of sinks.

Terminal accommodating chambers are provided in the terminal accommodating portion for individually accommodating the terminal fittings and are arranged side by side in the intersecting direction. The reinforcing wall may be provided continuously in the arrangement direction with a partition wall partitioning between the terminal accommodating chambers. According to this configuration, the strength of the housing can be increased as compared to the case where the reinforcing wall is displaced from the partition wall.

DETAILED DESCRIPTION

One specific embodiment of the invention is described in detail with reference to FIGS. 1 to 10. A connector assembly in accordance with this embodiment has a first connector 10 that can be connected to or separated from a second connector 40 by rotating a lever 30 provided on the first connector 10. In the following description, a connection surface side of each constituent member is referred to as the front, an upper side and a lower side in FIG. 6 are referred to as an upper side and a lower side.

Figure 3:
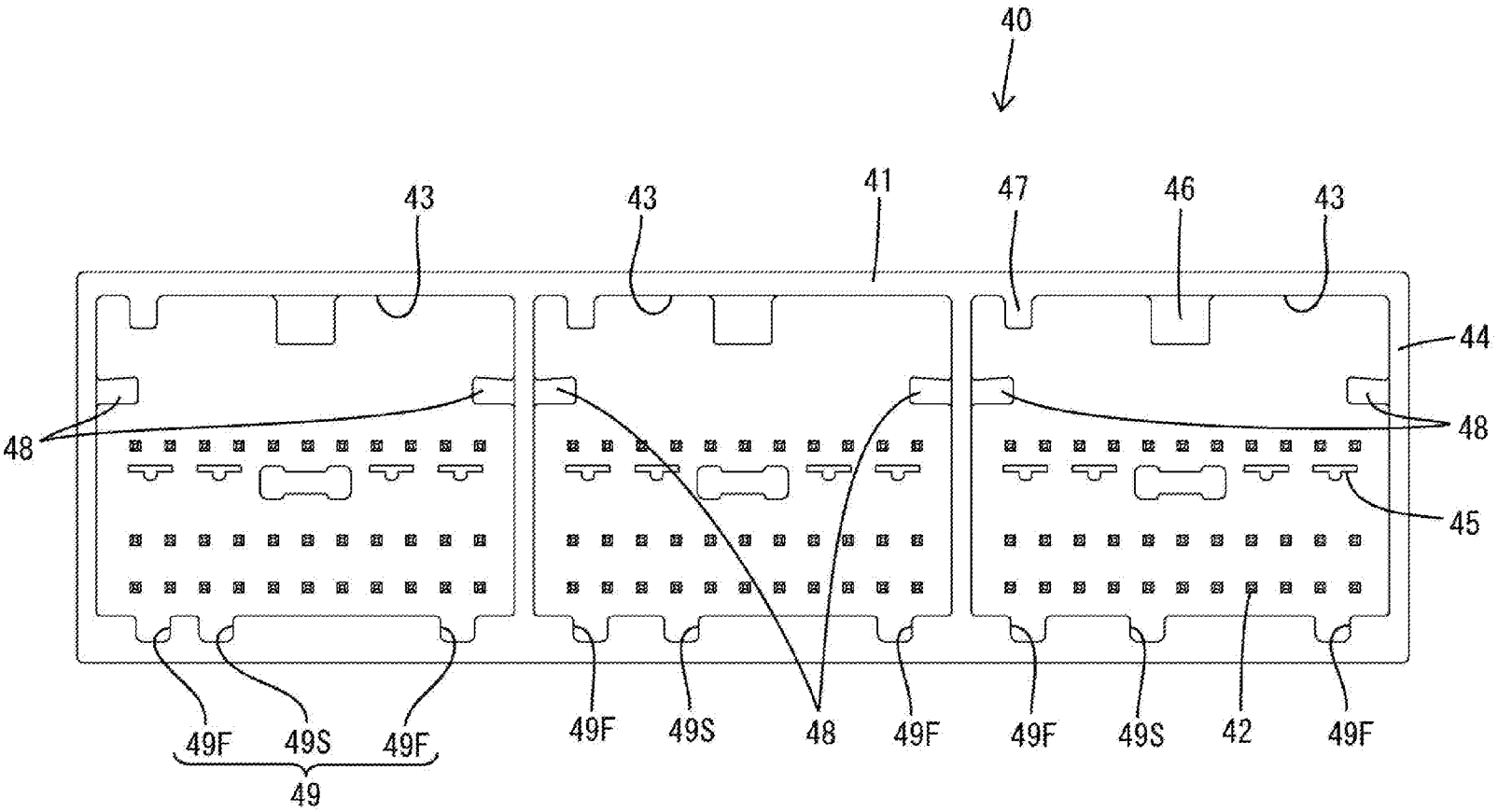
FIG. 3 is a front view showing a second connector.

The second connector 40 is a board connector to be connected to a board and includes a second housing 41 made of synthetic resin and second terminal fittings 42 bent into an L shape. As shown in FIG. 3, the second housing 41 has three connector fitting portions 43 into which the first connectors 10 are fit individually.

Each connector fitting portion 43 includes a forwardly open receptacle 44, and the first connector 10 is fit into the receptacle 44. The second terminal fittings 42 are mounted in each connector fitting portion 43 in a state where tip parts thereof project into the receptacle 44. Further, short releasing portions 45 are provided in each connector fitting portion 43 and project into the receptacle 44 for releasing a shorted state of unillustrated shorting terminals for shorting first terminal fittings 12 held in the first connector 10 in the process of connecting the first connector 10.

A cylindrical cam pin 46 projects down toward an inner space of the receptacle 44 on the upper wall of the receptacle 44 of each connector fitting portion 43. The cam pin 46 is provided at a position closer to a front end than a center in a front-back direction of the receptacle 44.

A lock releasing portion 47 projects down from the upper wall of the receptacle 44 of each connector fitting portion 43 for releasing the initial locking of the lever 30. The lock releasing portion 47 extends straight in the front-back direction from the front end to the rear end of the receptacle 44.

Fitting grooves 49 are provided on the lower wall of each connector fitting portion 43 and fitting ribs 28 can be fit respectively therein from the front (see FIG. 3). The fitting grooves 49 include first fitting grooves 49F provided at the same positions in all of the connector fitting portions 43 and a second fitting groove 49S provided at a different position in each connector fitting portion 43. Two of the first fitting grooves 49F are provided at positions near opposite lateral ends of each connector fitting portion 43 and the second fitting groove 49S is arranged between the first fitting grooves 49F.

Guide ribs 48 project on the inner peripheral surface of the receptacle 44. The guide ribs 48 are described in detail later.

The first connector 10 includes a first housing 11 made of synthetic resin, the first terminal fittings 12 and unillustrated shorting terminals for shorting adjacent first terminal fittings 12.

Each shorting terminal is in contact with and shorts a corresponding pair of the first terminal fittings 12 before the first connector 10 is connected to the second connector 40. The short releasing portion 45 of the second housing 41 brings the shorting terminal and the first terminal fittings 12 out of contact to release a shorted state of the first terminal fittings 12 when the first connector 10 is connected to the second connector 40.

The first housing 11 has a substantially rectangular block shape that can fit into the receptacle 44 of the second housing 41 and includes the terminal accommodating portion 13 for accommodating the first terminal fittings 12 and the lever accommodating portion 14 for accommodating the lever 30.

The first connector 10 has guide grooves 15 into which the guide ribs 48 of the second connector 40 fit, and a lightening portion 16 is provided in a part of the first housing 11 located inward of the guide grooves 15.

Terminal accommodating chambers 13R for individually accommodating the first terminal fittings 12 are provided in the terminal accommodating portion 13. The terminal accommodating chambers 13R are arranged side by side in a lateral direction in each of a plurality of stages divided in a vertical direction. The terminal accommodating chambers 13R in each stage are equal in number and are arranged at equal intervals.

The first terminal fittings 12 connected respectively to end parts of wires W are inserted respectively into each terminal accommodating chamber 13R from behind. The first terminal fitting 12 inserted to a proper position into the terminal accommodating chamber 13R is locked and retained by an unillustrated locking lance in the terminal accommodating chamber 13R. The wire W then is pulled out from the rear surface of the first housing 11.

A front holder 29 is mounted on a front of the terminal accommodating portion 13 (see FIG. 1) and is shaped to cove substantially the entire front surface of the terminal accommodating portion 13. The front holder 29 constitutes the front wall of each terminal accommodating chamber 13R and closes a front of the lightening portion 16 to be described later.

The terminal accommodating portion 13 includes a retainer 26 for locking the first terminal fittings 12 (see FIG. 6). The retainer 26 is mounted in a retainer mounting portion 27 provided in a substantially central part of the terminal accommodating portion 13 in a front-back direction. The retainer mounting portion 27 is open on a lower surface of the terminal accommodating portion 13 and vertically communicates up to the terminal accommodating chambers 13R in the uppermost stage. The retainer 26 mounted in the retainer mounting portion 27 is vertically movable between a partial locking position where parts for locking the first terminal fittings 12 are retracted down from the terminal accommodating chambers 13R and a full locking position where the parts for locking the first terminal fittings 12 are located in the terminal accommodating chambers 13R.

Figure 1:
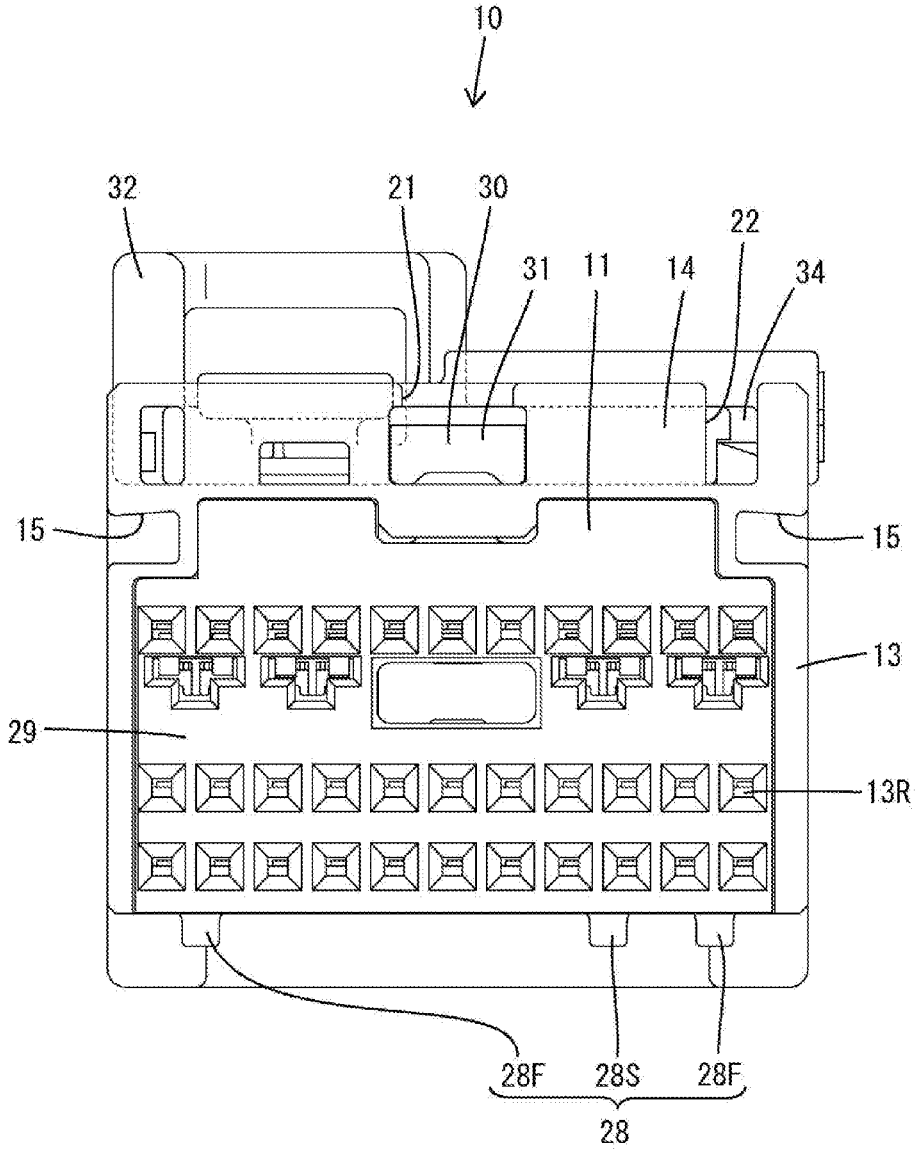
FIG. 1 is a front view showing a first connector in an embodiment.

Three fitting ribs 28 respectively fittable into the three fitting grooves 49 provided in the second connector 40 are provided to project on the lower surface of the first housing 11 (see FIG. 1). The fitting ribs 28 include first fitting ribs 28F provided at the same positions in all the first connectors 10 to be connected to the second connector 40 and a second fitting rib 28S provided at a different position in each connector 10. The second fitting rib 28S is provided at a position corresponding to the second fitting groove 49S provided in the connector fitting portion 43 into which each first connector 10 is to be fit. When the first connector 10 and the connector fitting portion 43 are connected in a proper combination, all the fitting ribs 28 are fit into the fitting grooves 49. When it is attempted to connect the first connector 10 and the connector fitting portion 43 in a wrong combination, the second fitting rib 28S collides with the front end of the receptacle 44 after tips of the first fitting ribs 28F are fit into the first fitting grooves 49F, thereby preventing erroneous connection.

Figure 4:
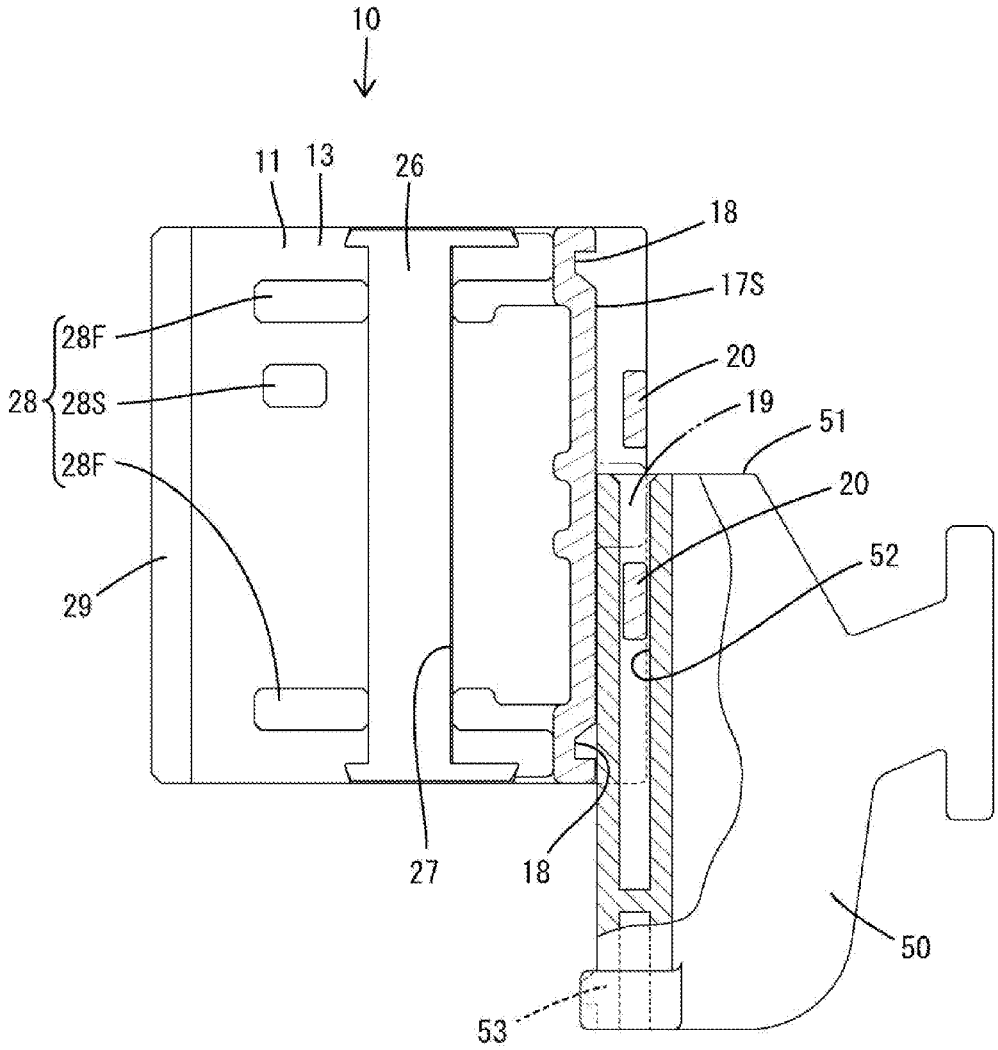
FIG. 4 is a plan view partially cut away and in section showing a state of mounting the wire cover on the first connector.

As shown in FIG. 4, a wire cover 50 for covering pulled-out parts of the wires W is slid in the lateral direction (direction intersecting a pull-out direction of the wires W) to be mounted on the rear surface of the first housing 11. Slides 17 are provided on the rear surface of the first housing 11 and slidably engage a front edge of the wire cover 50 slid in the lateral direction.

Figure 10:
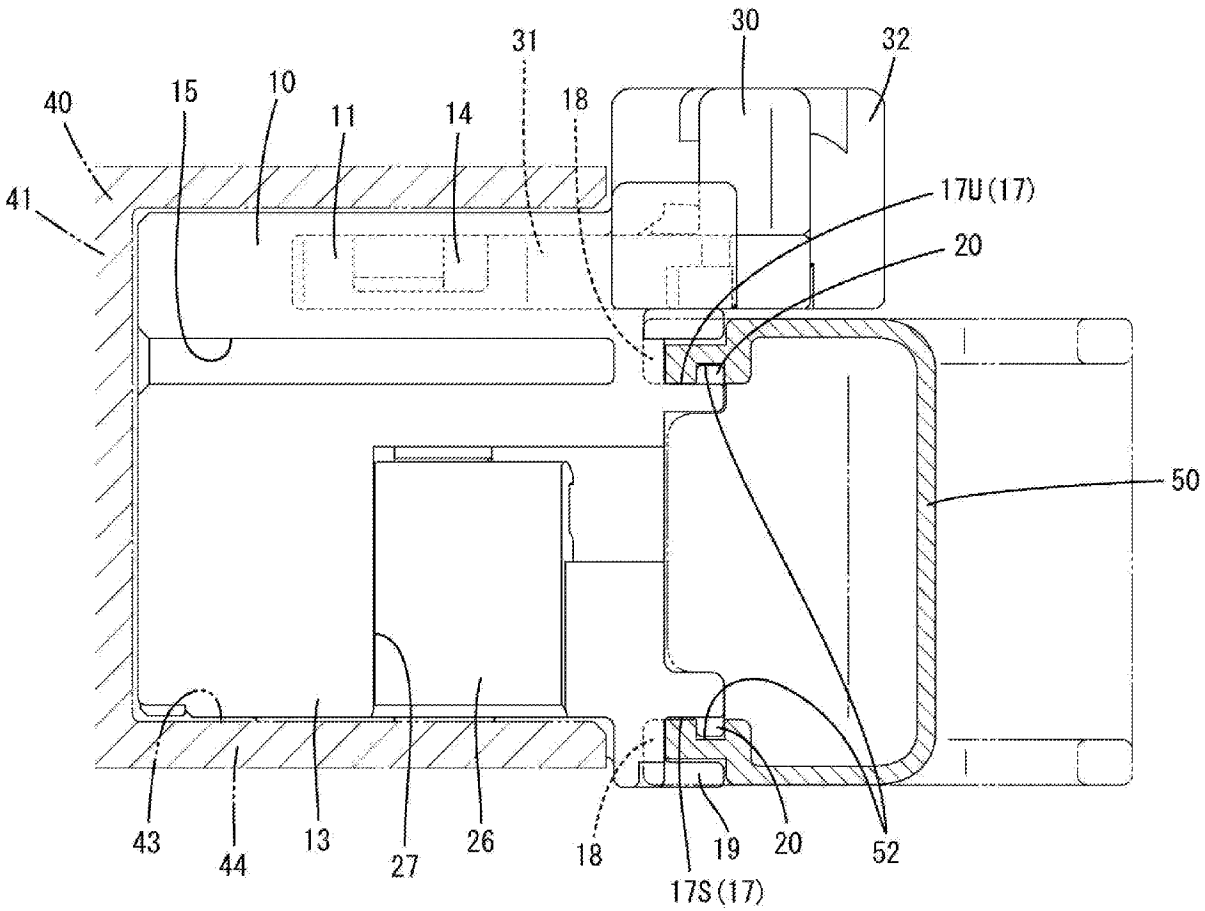
FIG. 10 is a side view in section showing the state where the first connector having the wire cover mounted thereon and the second connector are properly connected.

As shown in FIG. 10, the slides 17 are provided on opposite upper and lower sides of the first housing 11 and both of them are spaces open to the back, left and right. This enables the wire cover 50 to be mounted on the first housing 11 with the orientation thereof in the lateral direction changed. Note that a depth (dimension in the front-back direction) of the slide 17 is slightly larger than a vertical dimension thereof.

The slide 17 on the upper side (hereinafter, referred to as an upper slide 17U) and the slide 17 on the lower side (hereinafter, referred to as an upper slide 17S) are equivalent in size. The upper slide 17U is formed substantially at the same height position as the guide grooves 15 and a vertical dimension thereof is equivalent to that of the guide grooves 15. The lower slide 17S is provided on the lower surface of the first housing 11 to project slightly downwardly. Cover locks 18 to which cover locking pieces 53 of the wire cover 50 are lockable are provided on opposite left and right end parts of each slide 17 (see FIG. 5).

Figure 2:
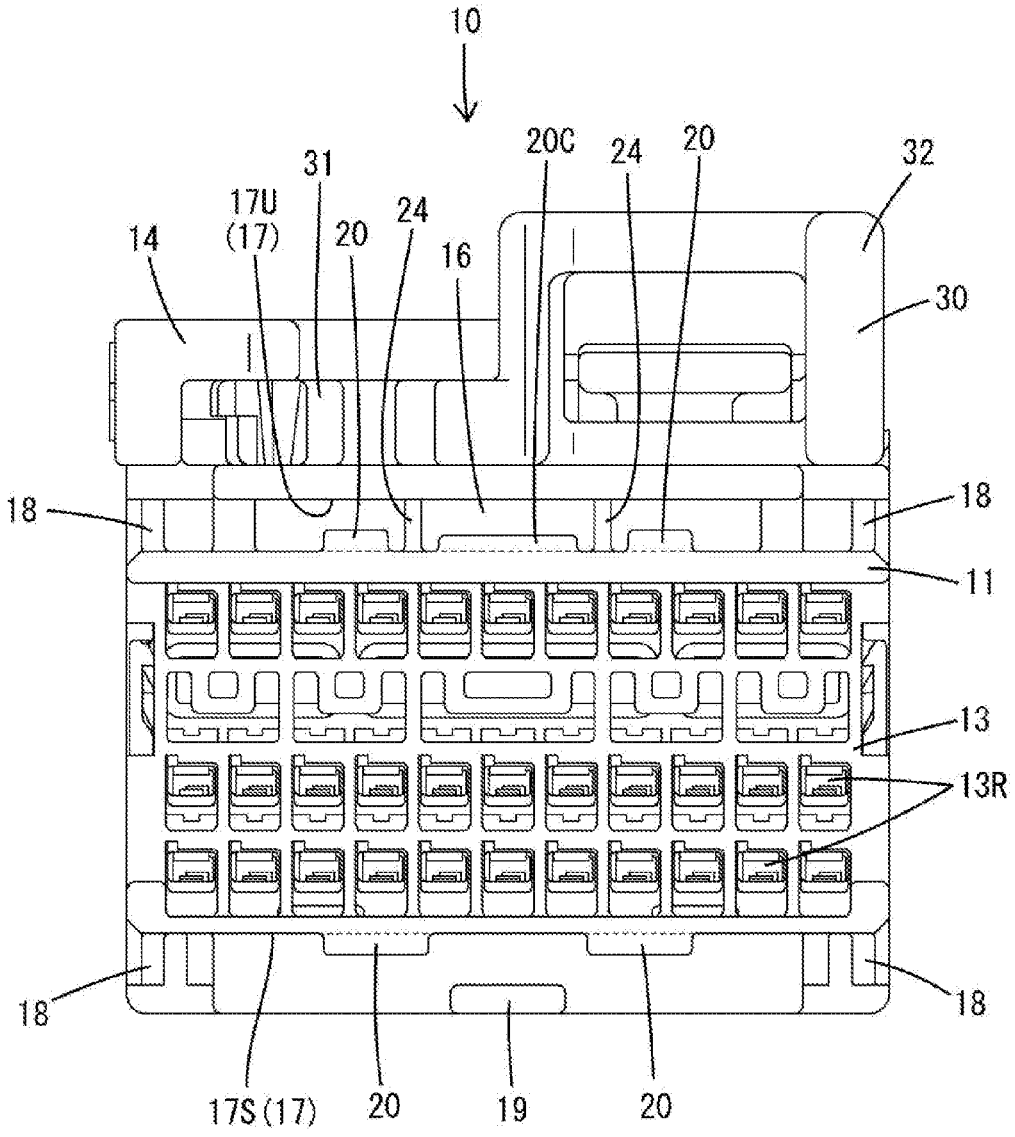
FIG. 2 is a rear view showing the first connector in a state where a wire cover is not mounted.

The lower wall of the upper slide 17U and the upper wall of the lower slide 17S are provided over the entire width of the first housing 11 as shown in FIG. 2. Further, the upper wall of the upper slide 17U is provided over the entire width of the first housing 11 except at opposite left and right end parts. The lower wall of the lower slide 17S is provided only in a substantially central part of the first housing 11 in the lateral direction. This lower wall serves as a finger placing portion 19 on which finger is easily placed during a connecting operation to the second connector 40 when the first connector 10 is used without the wire cover 50 being mounted thereon.

Each slide portion 17 is provided with guiding ribs 20 for guiding a sliding movement of the wire cover 50. Note that the guiding ribs 20 are described in detail later.

The lever accommodating portion 14 is open backward so that the lever 30 can be assembled from behind. The lever accommodating portion 14 is sized to spread substantially over the entire upper surface of the first housing 11 in the width direction.

Figure 9:
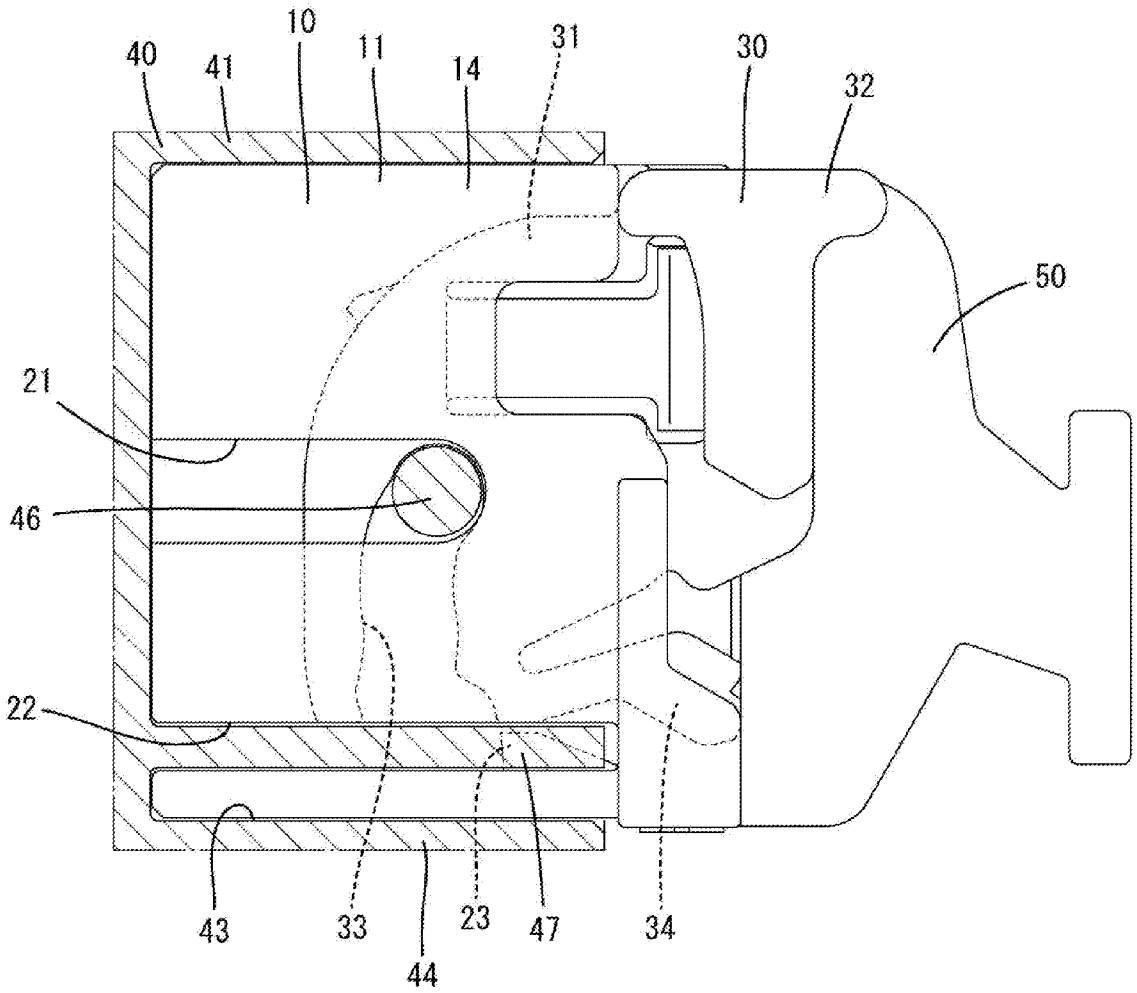
FIG. 9 is a plan view in section showing a state where the first connector having the wire cover mounted thereon and the second connector are properly connected.

As shown in FIG. 9, the lever accommodating portion 14 is provided with a first receiving path 21 for receiving the cam pin 46 of the second connector 40 and a second receiving path 22 for receiving the lock releasing portion 47. Both the first and second receiving paths 21, 22 extend straight back from the front end of the lever accommodating portion 14. The first receiving path 21 is located in a substantially central part of the first housing 11 in the width direction and the second receiving path 22 is located on one end side of the first housing 11 in the width direction.

Further, the lever accommodating portion 14 has a lock receiving portion 23 to which an initial locking piece 34 provided on the lever 30 is lockable. The lock receiving portion 23 is a projection projecting into the second receiving path 22 at a position near the rear end of the lever accommodating portion 14.

The lever 30 is a rotary lever 30 and includes a cam plate 31 made of synthetic resin and in the form of a flat plate and an operating portion 32 that is operated by placing the finger thereon in rotating the lever 30. The cam plate 31 of the lever 30 is assembled with the lever accommodating portion 14 with a tiny clearance, and the operating portion 32 projects back from the lever accommodating portion 14.

A cam groove 33 is formed on the upper surface of the cam plate 31 and is to be engaged with the cam pin 46 of the second connector 40. The cam groove 33 is a recess extending toward a center from an end edge of the cam plate 31. When the lever 30 is at an initial position, the entrance of the cam groove 33 is located in the first receiving path 21 so that the cam pin 46 can be received into the cam groove 33.

The cam plate 31 is provided with the initial locking piece 34 for holding the lever 30 at the initial position by locking the lock receiving portion 23 of the lever accommodating portion 14 when the lever 30 is at the initial position. The initial locking piece 34 is cantilevered from the vicinity of the entrance of the cam groove 33 in a rotating direction of the lever 30 from the initial position to a connection position. A tip of the initial locking piece 34 in an extending direction is locked to the lock receiving portion 23.

As shown in FIG. 10, the wire cover 50 has a U-shaped cross-section open toward the front and is open only on one end side in the lateral direction. The wires W pulled out from the first housing 11 are bent in the wire cover 50 and pulled out from the open side (hereinafter, referred to as a cover opening 51). Note that a lateral dimension of the wire cover 50 is substantially equal to that of the first housing 11.

Figure 5:
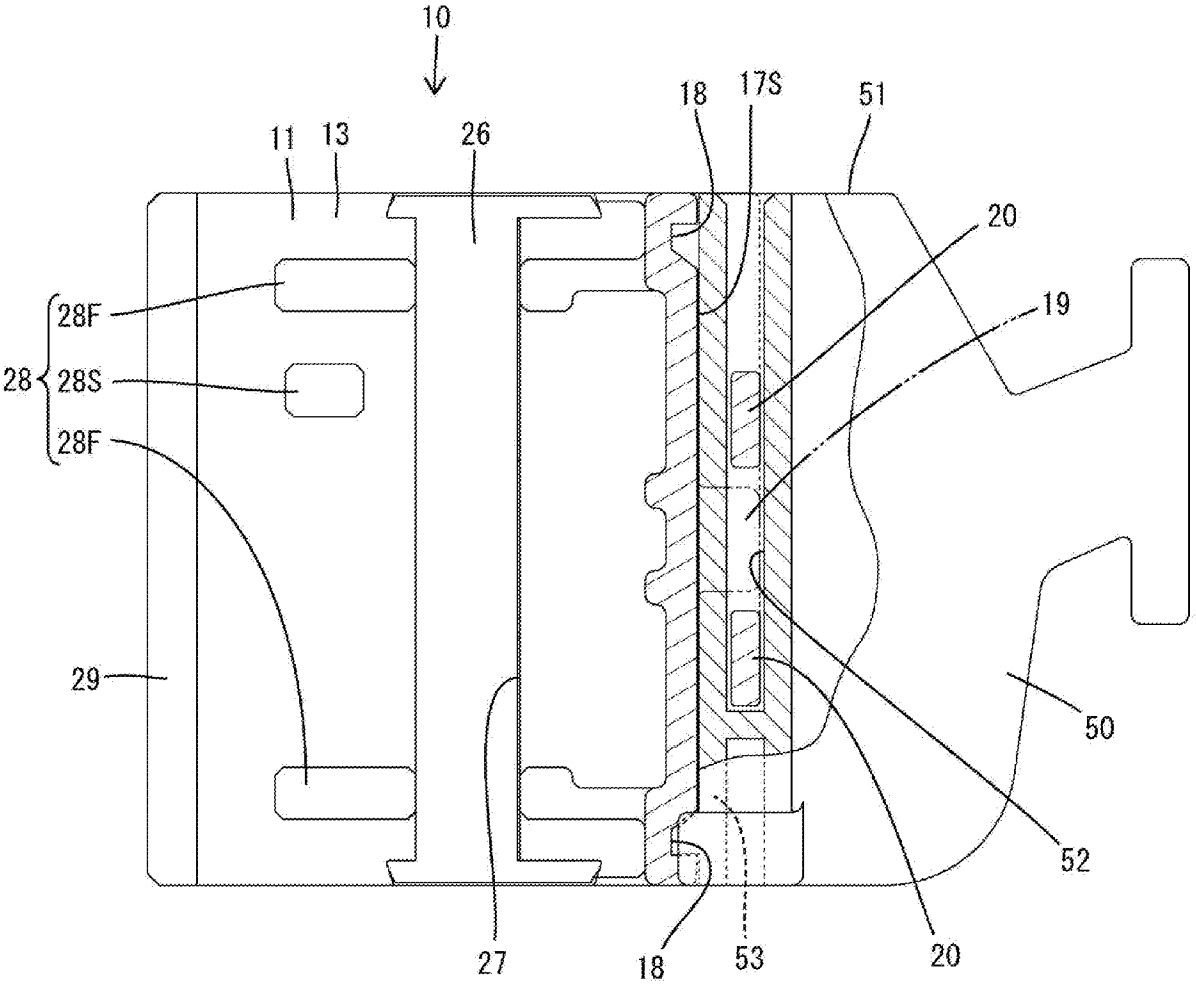
FIG. 5 is a plan view partially cut away and in section showing a state where the wire cover is mounted on the first connector.
Figure 6:
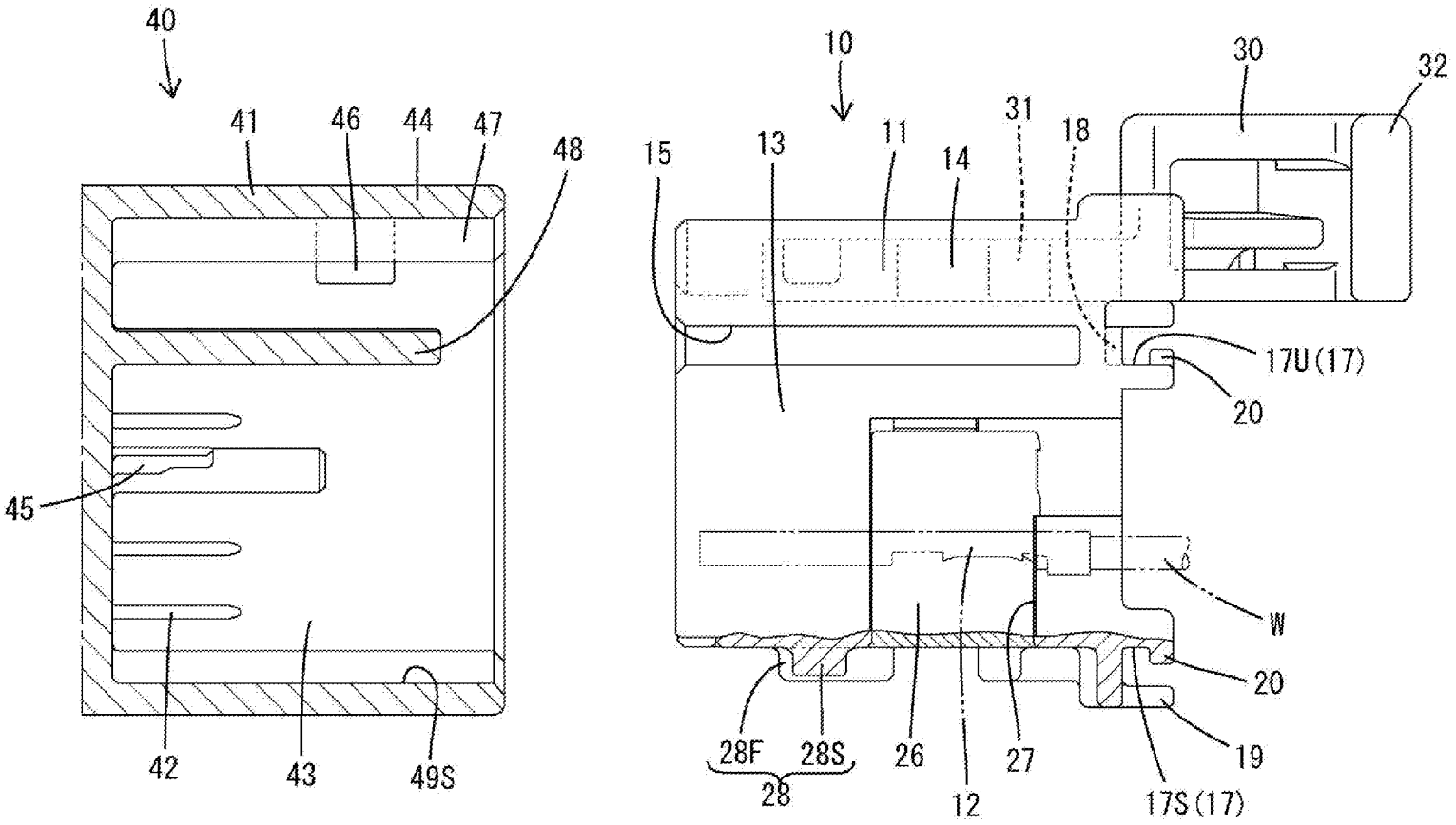
FIG. 6 is a side view partially cut away and in section showing a state before the first connector without the wire cover being mounted thereon is connected to the second connector.

As shown in FIGS. 4 and 5, slide grooves 52 are formed in a front edge of the wire cover 50 and extend in the lateral sliding direction. The slide grooves 52 are provided on opposite upper and lower sides of the wire cover 50, open on the side of the cover opening 51 in the lateral direction and closed on the other side. The guiding ribs 20 to be described later are inserted into these slide grooves 52.

The cover locking pieces 53 are provided on one end side of the wire cover 50 in the lateral direction and are to be locked to the cover locks 18 of the first housing 11 to hold the wire cover 50 slid to a proper position in position. The cover locking pieces 53 are provided on an end part of the wire cover 50 opposite to the cover opening 51 (rear end in the sliding direction during mounting). The cover locking pieces 53 are cantilevered back (down in FIG. 4) in the sliding direction during mounting.

As shown in FIG. 3, the guide ribs 48 project on the inner peripheral surface of the receptacle 44 of the second connector 40. Two of the guide ribs 48 are provided on opposite left and right sides of the receptacle 44 and at positions substantially at the same height and closer to an upper end than a center in the vertical direction. The pair of guide ribs 48 are bilaterally symmetrical and each guide rib 48 has such a rectangular shape that a lateral dimension (projecting distance from the receptacle 44) is slightly larger than a vertical dimension when viewed from the front. The lower surface of each guide rib 48 is substantially horizontal and extends substantially at a right angle from the inner peripheral surface of the receptacle 44. The upper surface of each guide rib 48 is inclined gradually down from an inner projecting end edge toward an outer end edge at the inner peripheral surface of the receptacle 44.

As shown in FIG. 6, the guide rib 48 extends straight back from a position slightly behind the front end of the receptacle 44 and before the cam pin 46. The rear end of the guide rib 48 reaches a back wall of the receptacle 44.

The first connector 10 is provided with the guide grooves 15 that receive the guide ribs 48 of the receptacle 44 without clearance in the vertical direction. The guide grooves 15 are provided between the terminal accommodating portion 13 and the lever accommodating portion 14. As shown in FIG. 1, the guide grooves 15 are formed by recessing the opposite left and right surfaces of the first housing 11 and open forward. Each guide groove 15 has a shape matching the guide rib 48 of the receptacle 44, the lower surface is substantially horizontal and the upper surface is moderately inclined. The two guide grooves 15 are located substantially at the same position in the vertical direction and are bilaterally symmetrical. Additionally, the guide grooves 15 are located near the upper end than the center of the first housing 11 in the vertical direction.

As shown in FIG. 6, each guide groove 15 extends back from the front end of the first housing 11 and the rear end thereof is near the rear surface of the first housing 11. Note that parts of the first housing 11 behind the guide grooves 15 serve as the cover locks 18 to which the cover locking pieces 53 of the wire cover 50 are lockable in the lateral direction.

The guiding ribs 20 for guiding a sliding movement of the wire cover 50 are provided on the rear surface of the first housing 11. The guiding ribs 20 stand on the rear end of the respective slide portions 17. The guiding rib 20 is in the form of a wall having a thickness which is substantially about half the dimension of each slide portion 17 in the front-back direction. The guiding ribs 20 are so dimensioned that the front edge part of the wire cover 50 is insertable into the slide portions 17 without clearance. Further, the guiding ribs 20 on the upper slide portion 17U and those on the lower slide portion 17S are substantially identically shaped when viewed laterally, as shown in FIG. 6. The guiding ribs 20 on the upper slide portion 17U are provided within a formation range of the guide groove 15 in the vertical direction of the first housing 11.

As shown in FIG. 2, guiding ribs 20 are provided on each slide portion 17. In this embodiment, three guiding ribs 20 are provided on the upper slide portion 17U and two guiding ribs 20 are provided on the lower slide portion 17S.

The upper slide portion 17U has one guiding rib 20 substantially in a lateral center of the first housing 11 and two guiding ribs 20 at opposite sides of the one guiding rib 20. The guiding rib 20 in a central part of the upper slide portion 17U (hereinafter, referred to as a central guiding rib 20C) is larger than the other two guiding ribs 20 in the lateral direction, but smaller in the vertical direction. The central guiding rib 20C is slightly wider than the finger placing portion 19 in the lateral direction. The guiding ribs 20 at the opposite sides of the central guiding rib 20C are arranged at the same distance from the central guiding rib 20C and are shaped identically. In other words, the guide ribs 20 on the upper slide portion 17U are bilaterally symmetrical with respect to a lateral center line of the central guiding rib 20C.

Left and right guiding ribs 20 are provided on the lower slide portion 17S with respect to the lateral center of the first housing 11 and have substantially identical sizes. The finger placing portion 19 is in a center between the two guiding ribs 20.

The lightening portion 16 is provided in a part of the first housing 11 located inwardly of the guide grooves 15 (see FIG. 2). The lightening portion 16 is provided in a substantially entire central part, leaving opposite end parts in the lateral direction. The lightening portion 16 is formed into a rectangular shape flat in the lateral direction when viewed from behind, and penetrates through an upper side of the terminal accommodating portion 13 of the first housing 11 in the front-back direction.

The lightening portion 16 has reinforcing walls 24 that are coupled to the upper and lower surfaces of the lightening portion 16, stand substantially vertically and divide the lightening portion 16 in the lateral direction. The reinforcing walls 24 are displaced from the guiding ribs 20 on the upper slide portion 17U in the lateral direction and face forward of the terminal accommodating portion 13 via the lightening portion 16. The reinforcing walls 24 are provided at opposite sides of the central guiding rib 20C. The reinforcing walls 24 are formed continuously in the front-back direction and the rear ends thereof are located in the vicinity of the slide portion 17.

Figure 8:
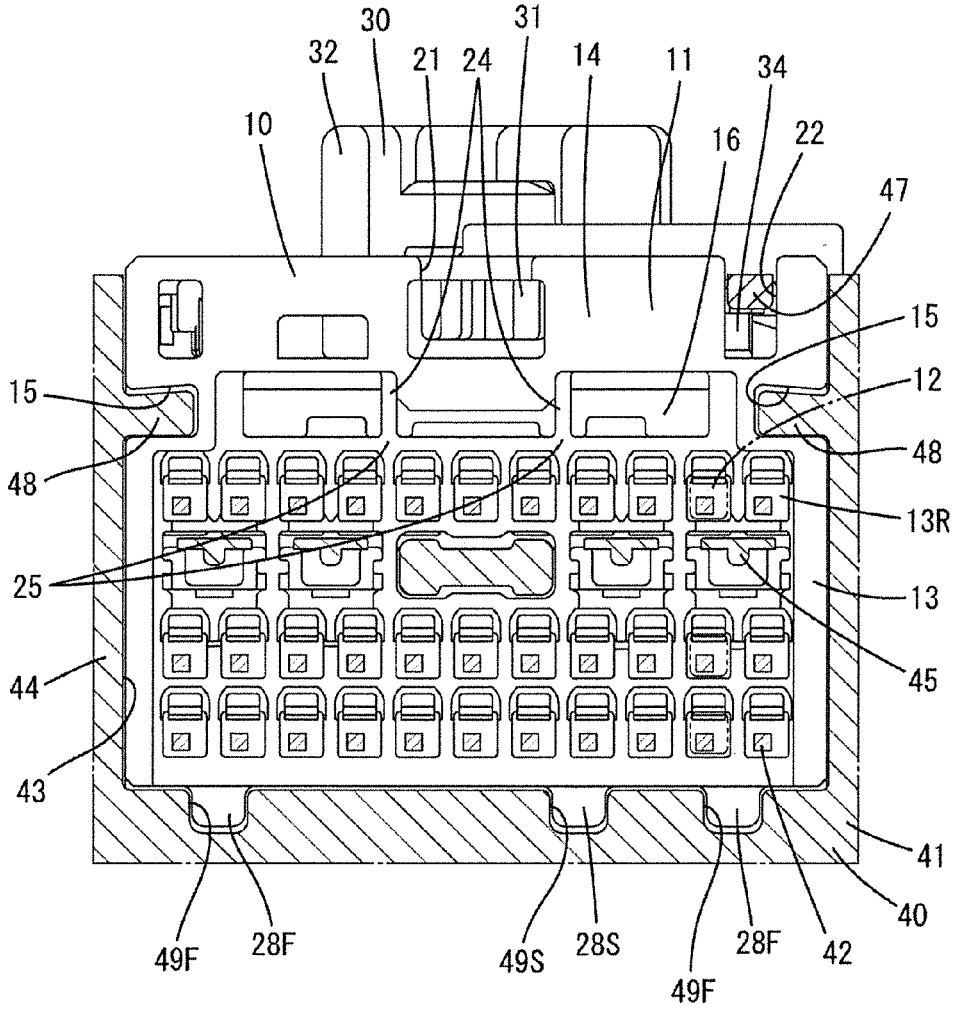
FIG. 8 is a front view partially cut away and in section showing a state where fitting ribs are fitted in fitting grooves.

As shown in FIG. 8, both reinforcing walls 24 are provided continuously up from partition walls and partition between the terminal accommodating chambers 13R. Note that the partition walls connected with the reinforcing walls 24 hang down substantially vertically to the lower end of the first housing 11. The reinforcing walls 24, the partition walls connected with the reinforcing walls 24 and the upper wall of the terminal accommodating portion 13 intersect substantially at a right angle and crossing portions 25 formed by the upper wall of the terminal accommodating portion 13 and the partition walls intersecting into a cross shape are formed at the lower ends of the reinforcing walls 24.

The lever 30 of the first connector 10 initially is set at the initial position and the wire cover 50 is mounted. As shown in FIG. 4, the front edge of the wire cover 50 is inserted into the slide portions 17 from the left or right side of the first housing 11 while the cover opening 51 of the wire cover 50 is arranged on a front side in the sliding direction and all of the wires W are accommodated into the wire cover 50. The guiding ribs 20 of the first housing 11 then are inserted into the slide grooves 52 of the wire cover 50. When the wire cover 50 is slid, the wires W are bent in the wire cover 50 and the cover opening 51 of the wire cover 50 reaches the opposite side of the first housing 11. Then, as shown in FIG. 5, the cover locking pieces 53 are locked to the cover locking portions 18 to restrict a sliding movement in an opposite direction. Further, the guiding ribs 20 reach the closed end parts of the slide grooves 52 to restrict a further sliding movement. The guiding ribs 20 and the slide grooves 52 are locked in the front-back direction to restrict detachment of the wire cover 50 in the front-back direction, thereby completing the mounting of the wire cover 50.

Figure 7:
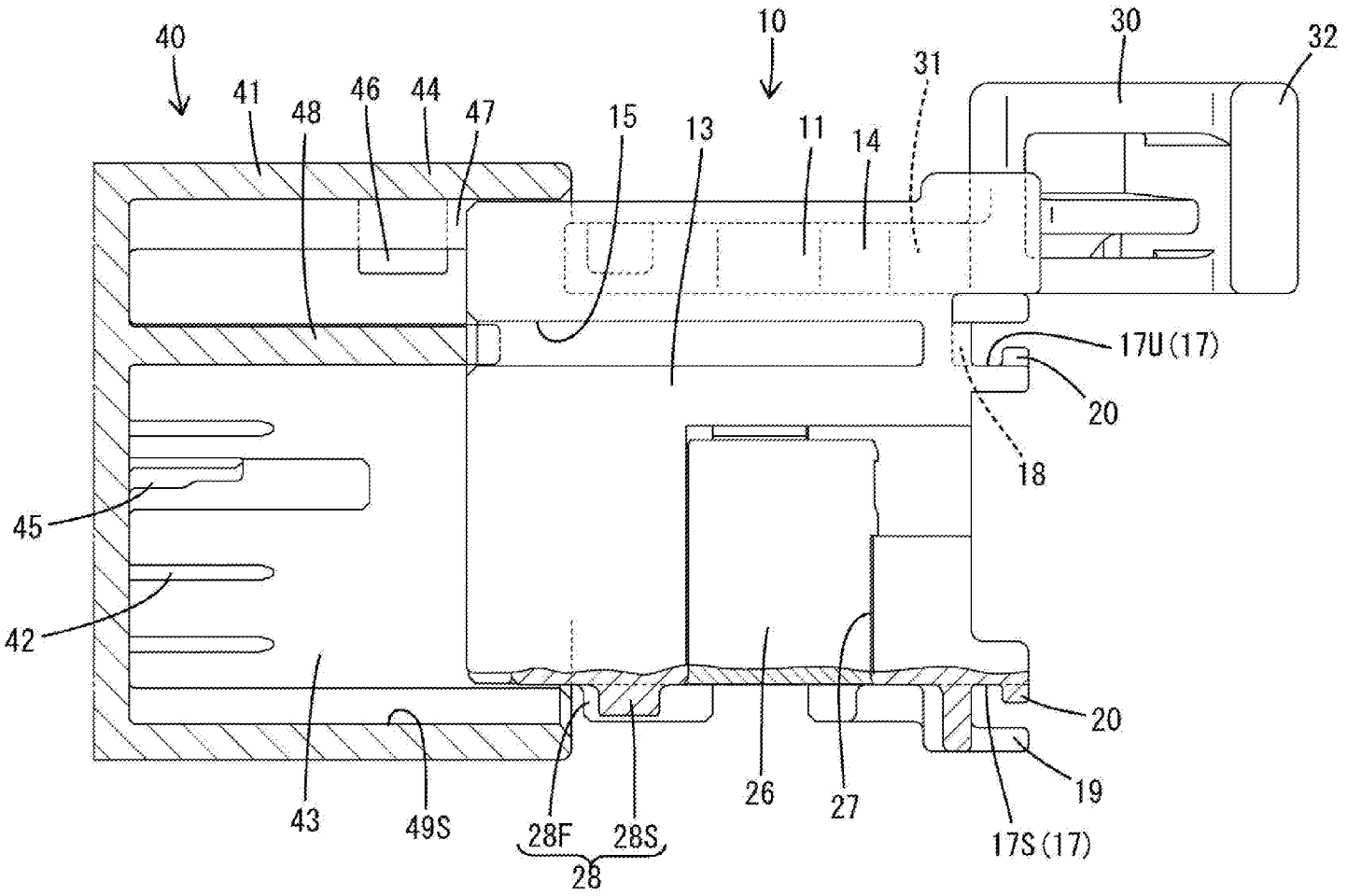
FIG. 7 is a side view partially cut away and in section showing a state where a guide rib is inserted in a guide groove.

The first connector 10 then is fit lightly into the receptacle 44 of the connector fitting portion 43, as shown in FIG. 7 (the wire cover 50 and the wires W are not shown). The front end parts of the guide ribs 48 then are inserted into front end parts of the guide grooves 15, and the fitting ribs 28 then are fit into the fitting grooves 49, as shown in FIG. 8. The cam pin 46 then enters the entrance of the cam groove 33 from the first receiving path 21 and the lock releasing portion 47 enters from the second receiving path 22 to release the locked state of the initial locking piece 34 and the lock receiving portion 23. In this way, a state is set where the lever 30 at the initial position is allowed to rotate.

The lever 30 then is rotated toward the connection position by pressing the operating portion 32 of the lever 30, and the first connector 10 is pulled toward the connector fitting portion 43 by the cam action of the cam pin 46 engaged in the cam groove 33 so that the first connector 10 is fit further into the receptacle 44 (see FIG. 9).

The upper side of the first connector 10 tends to move earlier than the lower side to incline the first connector 10 forward. However, the guide ribs 48 and the guide grooves 15 contact in the vertical direction to restrict the inclination. Thus, the first connector 10 moves forward without being inclined in the receptacle 44, i.e. while being kept in a proper posture in which the first terminal fittings 12 are arranged substantially parallel to the second terminal fittings 42. When the first connector 10 reaches a proper connection position with respect to the receptacle 44, the short releasing portions 45 release the shorted state between the specific first terminal fittings 12, and the respective first and second terminal fittings 12 and 42 are connected electrically. In this way, the operation of fitting the first connector 10 into one connector fitting portion 43 of the second connector 40 is completed. An operation of connecting all the first connectors 10 to the second connector 40 is completed by performing such a fitting operation for three first connectors 10.

The connector with lever of this embodiment is configured so that the first connector 10 is connected to or separated from the second connector 40 by operating the lever 30 on the first connector 10. Thus, the first connector 10 is fit into the receptacle 44 on the second connector 40. The first housing 11 of the first connector 10 includes the terminal accommodating portion 13 for accommodating the first terminal fittings 12 and the lever accommodating portion 14 for accommodating the lever 30. The guide grooves 15 are provided between the terminal accommodating portion 13 and the lever accommodating portion 14 and the guide ribs 48 projecting on the inner peripheral surface of the receptacle 44 are fit vertically in the guide grooves 15.

According to this configuration, the guide ribs 48 and the guide grooves 15 come into contact vertically at positions near the lever 30, i.e. at positions where the first connector 10 tends to incline forward by the operation of the lever 30. Therefore the inclination of the first connector 10 is prevented when the first connector 10 is fit into the receptacle 44 of the second connector 40.

The first terminal fittings 12 are connected to the end parts of the wires W, the wires W are pulled out from the rear of the first housing 11, the wire cover 50 for covering the pulled-out parts of the wires W is slid in the lateral direction to be mounted on the rear surface of the first housing 11, and the guiding ribs 20 for guiding a sliding movement of the wire cover 50 are provided within the formation range of the guide grooves 15 in the vertical direction of the first housing 11. Accordingly, the first connector 10 can be made compact as compared to the case where the guide grooves 15 and the guiding ribs 20 are provided at vertically displaced positions.

The lightening portion 16 is provided in the part of the first housing 11 inward of the guide grooves 15. According to this configuration, the part of the first housing 11 inward of the guide grooves 15 is not thick and sinks are not formed.

Further, the lightening portion 16 is provided with the reinforcing walls 24. Accordingly, it is possible to enhance the strength of the first housing 11 while preventing the formation of sinks.

The terminal accommodating chambers 13R for individually accommodating the first terminal fittings 12 are arranged side by side in the lateral direction in the terminal accommodating portion 13 and the reinforcing walls 24 are provided continuously upward from the partition walls between the terminal accommodating chambers 13R. According to this configuration, the strength of the first housing 11 can be increased as compared to the case where the reinforcing walls 24 are displaced from the partition walls.

The invention is not limited to the above described and illustrated embodiment. For example, the following embodiments also are included in the scope of the invention.

The above-described connector assembly is configured so that plural first connectors 10 are connected to the second connector 40. However, there is no limitation to this and the invention can be also applied, for example, so that first and second connectors are connected one to one.

Although the second connector 40 is a board connector in the above embodiment, there is no limitation to this and the invention can be also applied to cases where a second connector is not a board connector.

Although the guide grooves 15 are provided on the opposite left and right side surfaces of the first housing 11 in the above embodiment, there is no limitation to this and a guide groove may be provided only on one of the opposite left and right side surfaces of the first housing.

Although the guiding ribs 20 are provided on each slide portion 17 in the above embodiment, the number of the guiding ribs can be changed appropriately.

The lightening portion 16 penetrates through the upper part of the terminal accommodating portion 13 of the first housing 11 in the front-back direction in the above embodiment, there is no limitation to this. For example, a lightening portion may be a recess not penetrating through the terminal accommodating portion of the first housing in the front-back direction.

Although the reinforcing walls 24 are provided continuously upward from the partition walls partitioning between the terminal accommodating chambers 13R in the above embodiment, there is no limitation to this and reinforcing walls and partition walls may be at displaced positions.

LIST OF REFERENCE SIGNS

W . . . wire
10 . . . first connector
11 . . . first housing
12 . . . first terminal fitting
13 . . . terminal accommodating portion
13 . . . R terminal accommodating chamber
14 . . . lever accommodating portion
15 . . . guide groove
16 . . . lightening portion
20 . . . guiding rib
24 . . . reinforcing wall
30 . . . lever
40 . . . second connector
44 . . . receptacle
48 . . . guide rib
50 . . . wire cover

What is claimed is:

1. A connector assembly, comprising:

a first connector having a first housing defining a terminal accommodating portion for accommodating terminal fittings and a lever accommodating portion;

a second connector having a receptacle configured to receive at least a part of the first housing therein;

a lever movably mounted in the lever accommodating portion and configured so that the first connector is connected to or separated from the second connector by operating the lever;

a guide groove provided in the first housing between the terminal accommodating portion and the lever accommodating portion; and a guide rib projecting on an inner peripheral surface of the receptacle and being fit in the guide groove without clearance in an arrangement direction of the terminal accommodating portion and the lever accommodating portion.

2. The connector assembly of claim 1, further comprising:

the terminal fittings connected to end parts of wires;

the wires are pulled out from a rear surface of the first housing;

a wire cover mounted on the rear surface of the first housing by being slid in an intersecting direction intersecting with the arrangement direction, the wire cover being configured for covering pulled-out parts of the wires; and a guiding rib for guiding a sliding movement of the wire cover being provided within a formation range of the guide groove in the arrangement direction of the first housing.

3. The connector assembly of claim 2, wherein a lightening portion is provided in a part of the first housing located inwardly of the guide groove.

4. The connector assembly of claim 3, wherein the lightening portion is provided with a reinforcing wall.

5. The connector assembly of claim 4, wherein:

a plurality of terminal accommodating chambers are provided in the terminal accommodating portion for individually accommodating the terminal fittings, the terminal accommodating chambers being provided side by side in the intersecting direction; and the reinforcing wall. being provided continuously in the arrangement direction with a partition wall partitioning between the terminal accommodating chambers.

* * * * *